United States Patent [19]

Dudek et al.

[11] 4,154,628

[45] May 15, 1979

[54] QUENCH HARDENING OF GEARS

[75] Inventors: Otto Dudek, Oelde; Klaus Ortmann, Witten; Lothar Reichmann, Witten; Wilhelm Schäfer, Witten, all of Fed. Rep. of Germany

[73] Assignee: Mannesmann Aktiengesellschaft, Dusseldorf, Fed. Rep. of Germany

[21] Appl. No.: 851,259

[22] Filed: Nov. 14, 1977

[30] Foreign Application Priority Data

Nov. 15, 1976 [DE] Fed. Rep. of Germany ..... 2652386

[51] Int. Cl.[2] ..... C21D 9/32

[52] U.S. Cl. ..... 148/16.5; 29/159.2; 118/505

[58] Field of Search ..... 148/16.5; 29/159.2; 118/504, 505

[56] References Cited

U.S. PATENT DOCUMENTS

| | | | |
|---|---|---|---|
| 1,072,660 | 9/1913 | Shore | 148/19 |
| 2,520,334 | 8/1950 | Peters | 148/16.5 |
| 3,177,563 | 4/1965 | Pennell | 148/16.5 |
| 3,873,376 | 3/1975 | Ritzka | 148/16.5 |

FOREIGN PATENT DOCUMENTS

| | | | |
|---|---|---|---|
| 558616 | 6/1958 | Canada | 148/16.5 |

*Primary Examiner*—Arthur J. Steiner

*Attorney, Agent, or Firm*—Smyth, Pavitt, Siegemund, Jones & Martella

[57] ABSTRACT

A method of quench hardening a gear having a gear rim, a hub, and two rim carrying gear disk includes carburizing the gear and quenching it subsequently in a saline bath, and is improved by releasably covering the perforated disks with perforated supplemental disks, the perforations are closed during carburization but open during quenching. The gear is turned about its vertically positioned axis during quenching; the supplemental disks are removed subsequently so that the gear disks are not carburized.

4 Claims, 5 Drawing Figures

QUENCH HARDENING OF GEARS

BACKGROUND OF THE INVENTION

The present invention relates to hardening gears, particularly but not exclusively of large welded gears.

Gears to be hardened in accordance with the invention are, for example, composed of two annular disks having additional perforations and being welded onto a hub. The gear proper is established by a rim element to which the peripheries of the disks are welded. However, this special kind of gear is referred to here only because the invention arose from particular problems discovered in the current methods of hardening such gears. The inventive method may well have broad application in the art of quench-hardening other types of gears.

Gears of the type referred to above have been hardened by heating them in a carbon atmosphere to obtain carburization and by subsequently quenching the gear in a saline bath. It was discovered that the stengthening of gears, particularly for increasing the load bearing capability of the surfaces of the teeth, was limited by this quenching method which is usually followed by grinding.

Gears are made today which have a diameter up to 2700 mm (a little more than 10") and a gear teeth width (axial length) of 700 mm (a little less than 3"). It was found that hardening such gear is inadequate by, e.g. exposing the gear to a carbon atmosphere at a temperature between 900° or 950° C. in a pit furnace to obtain carburization and to quench the gears subsequently in a saline bath at 150° to 190° C.; the gears having a reduced temperature of about 820° to 850° just prior to dipping into the quenching bath.

We discovered that a major problem arises from the fact that the entire wheel is carburized, particularly, also, the welding seams, web elements and disks. Upon quenching, the disks cool faster than hub and rim so that the gear as a whole undergoes deformations (in addition to irregularities in the shape due to to tolerances, etc.). This resulting distortion, in turn, requires a more than desired amount of teeth grinding and polishing.

It was further observed that one of the main contributing factors to the irregular quenching relates to the flow of saline liquid in the bath. As long as the quenching vessel is empty, a rather uniform flow of the saline liquid of the bath can be established. As soon as a gear, particularly a large gear, is placed in the bath, the flow pattern becomes highly irregular, not only by the gear itself but also by the device dipping the gear into the bath and holding it therein. To equalize the flow or, better, to control the flow pattern under these conditions requires additional liquid circulating equipment which, moreover, has to be changed or, at least, readjusted or repositioned for gears of different sizes and dimensions, because each instance presents a different flow condition.

DESCRIPTION OF THE INVENTION

It is an object of the present invention to improve quench-hardening of gears, particularly of large gears with an internal space between two the gear carrying disks.

It is a specific object of the present invention to improve a hardening method for gears which includes carburization followed by quenching, so that detrimental effects one of these steps may have on the other and on the final product are excluded.

In accordance with the present invention it is suggested to cover the rim carrying a disk or disks during carburization and during quenching in such a manner that carburization of the rim carrying disk or disks is prevented while the same cover subsequently reduces the quenching speed for the rim carrying disk to about the quenching speed of the hub and of the rim. The cover is subsequently removed. The inventive improvement does not only protect the rim carrying disk or disks from carburization, but avoids also deformation of the assembly so that the subsequent grinding work is a minimal one.

If, as is contemplated in the preferred form of practicing the invention, the gear has two axially spaced, rim carrying disks, they should have perforations and the supplemental, covering disks should have registering perforations, but suitable elements close to the perforations during carburization to avoid exposure of the interior of the gear to the carbon (but pressure equalization should be permitted), while the perforations are opened during quenching to expose the interior of the gear to the quenching liquid. The gear should rotate or pivot back and forth about its axis, in vertical orientation, during quenching to expose the gear at different orientations to the flow pattern of the quenching bath. Such motion during quenching also enhances and equalizes the heat transfer in the interior of the gear and will also equalize the rising temperature of the quenching bath.

DESCRIPTION OF THE DRAWINGS

While the specifications concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
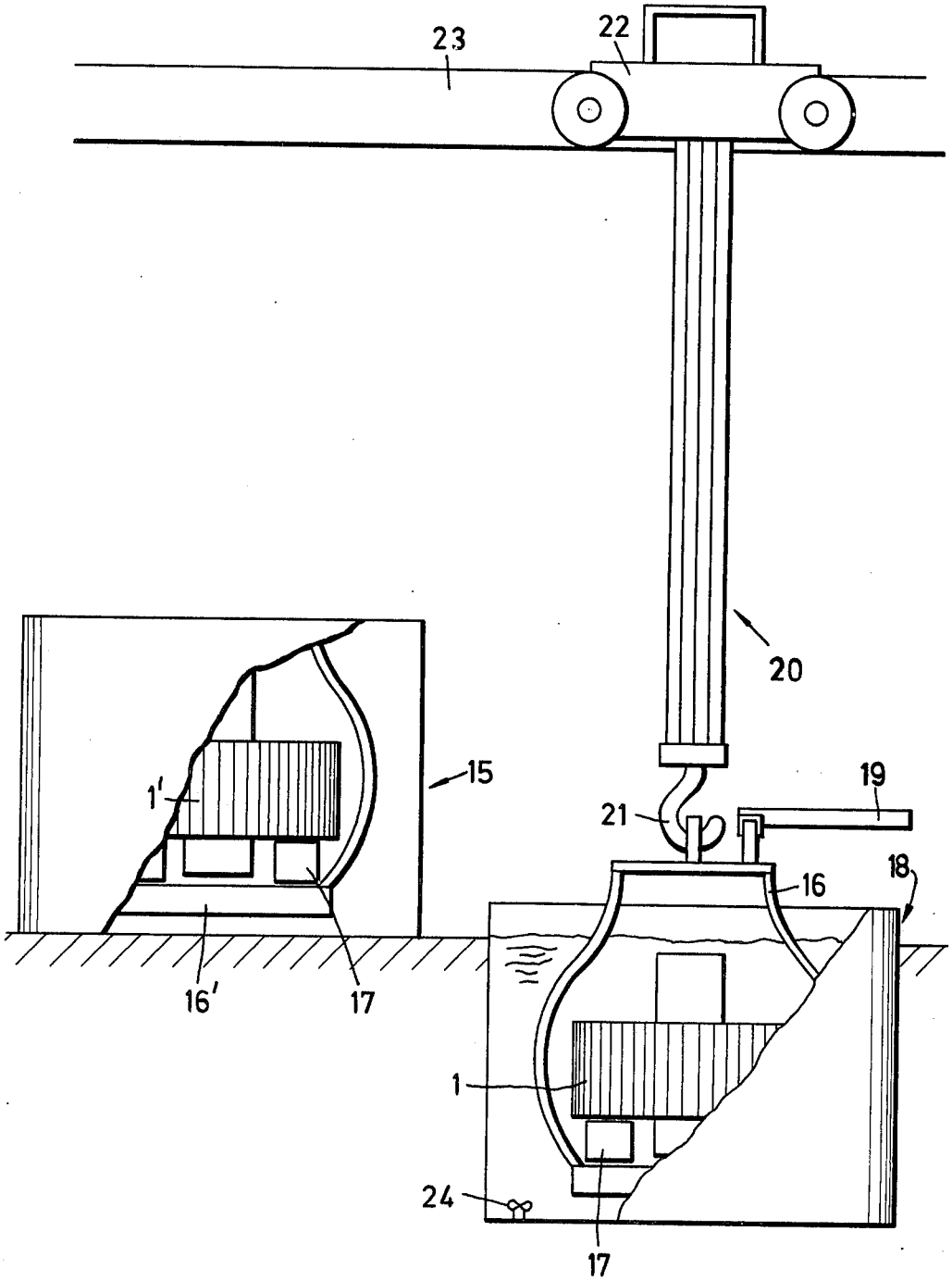
FIG. 1 is a schematic view of a complete equipment for hardening gears.
Figure 2:
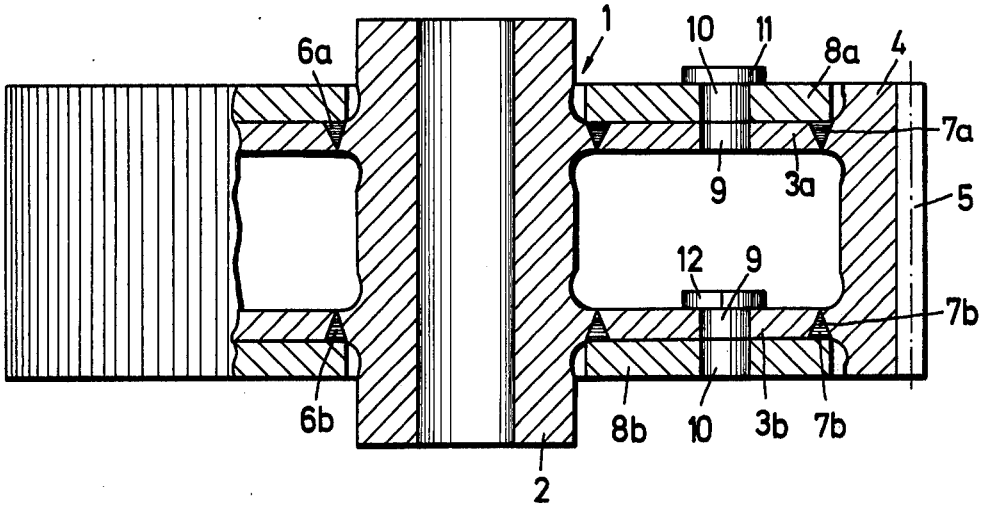
FIG. 2 is an axial section view of a gear to be hardened.
Figure 4:
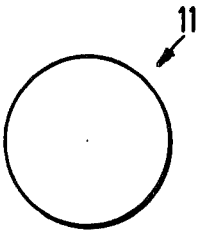
FIGS. 4 and 5 are top elevations of certain auxiliary elements to be used on the gear, shown in FIG. 2 and 3, during the process.
Figure 5:
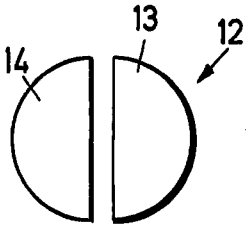

Proceeding now to the detailed description of the drawings, the hardening equipment shown in FIG. 1 includes a pit furnace 15, a vessel 18 for a saline bath for quenching, and moving and holding equipment 20 for placing a gear 1 into the furnace, removing it therefrom, moving the gear to the bath, holding it therein and removing the quenched gear from the bath for further working. This figure shows actually two gears 1, 1' as two can be processed at a time.

The moving and holding equipment 20 is comprised of a lifting structure suspended from a carriage 22 which runs on a rail 23. A first cage 16 is suspended from equipment 20 by a hook 21. This figure shows two cages, 16 and 16', the latter being placed in the furnace 15, and a gear 1' rests on support elements 17 of that cage. The other cage, 16, is suspended from equipment 20 holding the gear 1 in the saline bath in vessel 18. Reference numeral 24 refers to an agitator which produces a continuous flow of the saline liquid in the vessel 18, i.e. device 24 causes the liquid to circulate in a particular manner. For practicing the invention, it is not necessary to adapt the resulting flow pattern to different size gears.

The furnace 15 contains a carbon atmosphere as is known per se to heat the gear 1' therein to a temperature between 900° and 920° C. to obtain carburization. The saline bath in vessel 18 has a temperature of 160° which is increased slightly by the heat from the hot gear 1 being quenched. The quenching proper as far as the bath is concerned and the temperatures involved is likewise conventional per se.

Reference numeral 19 refers to a supplemental equipment for slowly turning the cage 16 in vessel 18 in order to equalize cooling of the gear 1 and to expose different portions of the gear to the flow pattern in that cage. Alternatively, cage 16 may be swiveled back and forth over a rather large angular range and for the same purpose. The main point is that the orientation of the gear is changed so that the gear be exposed to different positions of the flow pattern, generated by the agitator 24 and as modified by the cage and the gear in the bath. This swiveling or turning equipment 19 is operated until the gear and bath temperaturs have equalized.

The gears to be hardened are prepared in a manner to be explained next with reference to FIGS. 2 to 5. The gear is comprised of a hub element 2, a gear rim 4 and two annular disks 3*a* and 3*b*. The rim element carries or has teeth 5. The disks 3*a* and 3*b* are welded onto the hub 2 in a particular axial distance from each other. Reference numerals 6*a* and 6*b* respectively refer to the two welding seams. The rim element 4 is welded to the two outer peripheries of the two disks, the two welding seams are respectively identified by numerals 7*a* and 7*b*. Rim, hub and disks define an interior space or cavity.

Now, in accordance with the invention, the two disks 3*a* and 3*b* are temporarily covered by supplemental disks 8*a* and 8*b* which are slightly wider (radially) than the disks 3*a* and 3*b* so that they also cover, from the outside, the four welding seams 6*a, b* and 7*a, b*.

Figure 3:
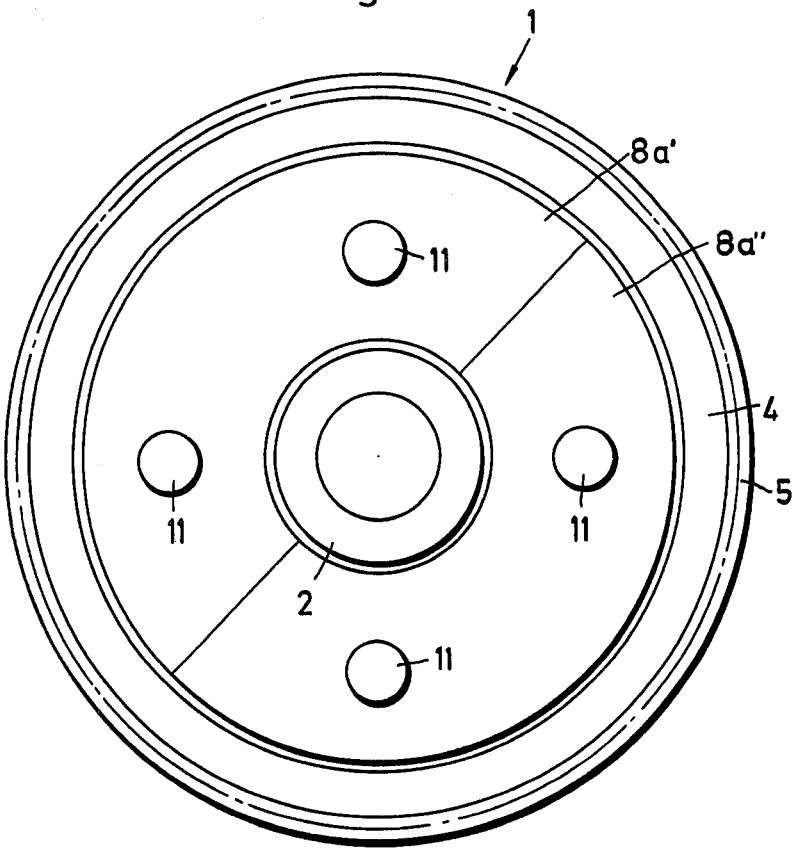
FIG. 3 is a top elevation of the gear shown in FIG. 2.

Actually, each supplemental disk is composed of two segments. FIG. 3 shows particularly that disk 8*a* is composed of the two segments 8*a'* and 8*a''*. It should be noted that the gears 1, 1' are held in the cages 16, 16' in a horizontal disposition. Thus, it suffices to just place the two segments 8*a'* and 8*a''* on top of disk 3*a*. On the other hand, the two segments making up disk 8*b* are fastened to the lower disk 3*b*, e.g. by clamps or the like.

The disks 3*a* and 3*b* have perforations 9 which are a part of their configuration. The perforations i.e. access to the interior space between the disks 3*a, b* is wanted, e.g. during the quenching; it is not wanted during the carburization treatment. Therefore, supplemental disks 8*a, b* are also provided with the perforations such as 10 which register respectively with the perforations 9, but the apertures are temporarily closed.

The perforations of the upper disk 8*a* are closed by wafers or small disks 11, they may be glued to the disk 8*a* by means of a protective paste or other bonding agent which will not be destroyed by the thermal carburization treatment. This way carbon is prevented from entering the interior between disks 3*a* and 3*b* from above. Biparted disks 12 (the parts being denoted 13 and 14, in FIG. 5) have been slipped through the apertures 9, 10 of the lower disk elements 8*b*, 3*b* and are pasted or glued onto disk 3*b* to cover the apertures 9 thereof. The radius of these disk segments 13, 14 should be smaller than the diameter of bores 9, 10; but the diameter of any of these cover disks must be larger. Thus, the interior space between disks 3*a, b* is completely sealed off. The sealing does not have to be air tight, but should filter out carbon while, on the other hand, pressure equalization inside of the gear should be permitted to take place. A gear to be used here should, for example, has its discs fixed by sort of cement.

During thermal treatment and carburization, only the exposed portions of the gear, but not the outside of the rim 4, the teeth 5 and the end parts of hub 2 are carburized. After the gear has been dipped into the saline solution the glue is dissolved so that the covers 11 and 12 are released; quenching liquid can readily enter the interior space between disks 3*a* and 3*b*. There is, of course, a certain delay before the quenching liquid in fact enters that space which is quite desirable. Moreover, the covers 8*a* and 8*b* remain in place and slow the outflow of heat from disks 3*a* and 3*b* so that the quenching is in fact a more uniform one. Assuming that the covers 8*a, b* be made from the same or similar material as the gear proper (which is a reasonable and practical assumption), one can see that a uniform quenching in the sense of a uniform reduction in temperatures of the several gear parts requires tha the covers 8*a, b* have a particular thickness. That thickness should be such that the combined (axial) thickness of disks 3*a* and 8*a*, and the analogous sum of the thickness of disks 3*b*, 8*b* is about equal to the radial width of rim 4 and the radial thickness of hub 2. It is assumed that the latter two values are about equal. They should not be too unequal, and in the case of a difference, the above identified sum should have value in between.

The invention is not limited to the embodiments described above but all changes and modificatons thereof not constituting departures from the spirit and scope of the invention are intended to be included.

We claim:

1. In a method of quench hardening a gear having a gear rim, a hub, and two gear disks, being mounted concentrically on the hub in axially spaced relationship, said disks also carrying the rim, the disks having perforations for access to the interior space between the disks, the rim and the hub having larger axial dimensions than the two disks as mounted, the method including carburizing the gear and quenching it subsequently in a saline bath, the improvement of releasably covering the two disks of the gear with supplemental disks prior to carburization, the supplemental disks also having perforations, respectively registering with the perforations of the rim carrying disks;

closing the perforations for closing the interior space between the disks prior to the carburization so that the gear disks are not carburized on the inside as well as on the outside, and the heat outflow from the gear disk is slowed by the supplemental disks during subsequent quenching;

opening the perforations prior to quenching so that a quenching liquid can enter the interior; and removing the supplemental disks after quenching.

2. In a method as in claim 1, and including using removable disks for closing the perforations.

3. In a method as in claim 1, and including turning or back and forth rotating the gear during quenching about its axis.

4. In a method as set forth in claim 1, selecting the supplemental disks each to ahve a thickness so that the combined thickness of the gear disks as mounted and of the supplemental disks as placed for covering is about equal to a radial thickness of the hub and/or of the rim.

* * * * *